US008887392B1

(12) United States Patent
Xu et al.

(10) Patent No.: US 8,887,392 B1
(45) Date of Patent: Nov. 18, 2014

(54) APPARATUS AND METHODS FOR CONNECTING A DRAIN PAN OVERFLOW SENSOR TO A DUCTLESS MINI-SPLIT HVAC SYSTEM

(71) Applicant: The Rectorseal Corporation, Houston, TX (US)

(72) Inventors: Zhengyi Xu, Houston, TX (US); Robert Allen Martinelli, Katy, TX (US)

(73) Assignee: The Rectorseal Corporation, Houston, TX (US)

( * ) Notice: Subject to any disclaimer, the term of this patent is extended or adjusted under 35 U.S.C. 154(b) by 178 days.

(21) Appl. No.: 13/669,761

(22) Filed: Nov. 6, 2012

Related U.S. Application Data

(60) Provisional application No. 61/628,935, filed on Nov. 9, 2011, provisional application No. 61/630,627, filed on Dec. 15, 2011, provisional application No. 61/742,729, filed on Aug. 17, 2012.

(51) Int. Cl.
*B23P 15/26* (2006.01)
*F16M 13/02* (2006.01)
*F24F 13/22* (2006.01)

(52) U.S. Cl.
CPC ..... *F16M 13/02* (2013.01); *F24F 13/22* (2013.01)
USPC ..... 29/890.035; 73/1.73; 248/205.1; 340/612

(58) Field of Classification Search
CPC ..... B60H 1/3233; F25D 2321/143; F25D 2321/144; F25D 2321/1441; F25D 2321/1442; F25D 21/14; G01F 25/0061; H01H 35/18
USPC ..... 29/890.035; 60/150; 73/1.73; 200/84 R; 248/205.1, 229.15, 229.16, 229.17, 248/544
See application file for complete search history.

(56) References Cited

U.S. PATENT DOCUMENTS

| | | | | |
|---|---|---|---|---|
| 4,633,673 | A | 1/1987 | Morrison et al. | |
| 6,442,955 | B1 | 9/2002 | Oakner et al. | |
| 6,698,215 | B2 * | 3/2004 | Bush et al. | 62/150 |
| 6,992,259 | B1 | 1/2006 | Cantolino | |
| 6,992,260 | B1 | 1/2006 | Cantolino | |
| 7,010,928 | B2 * | 3/2006 | Spanger | 62/150 |
| 7,067,749 | B1 | 6/2006 | Cantolino | |
| 7,067,750 | B1 | 6/2006 | Cantolino | |
| 7,710,283 | B1 * | 5/2010 | Cantolino | 340/623 |
| D630,709 | S | 1/2011 | Cantolino | |
| 7,896,301 | B1 | 3/2011 | Cantolino | |
| 7,967,267 | B1 | 6/2011 | Cantolino | |
| 8,151,580 | B1 | 4/2012 | Cantolino | |
| 8,151,621 | B1 | 4/2012 | Cantolino | |
| 2007/0157725 | A1 * | 7/2007 | Fling et al. | 73/313 |
| 2014/0260520 | A1 * | 9/2014 | Schoenberg | 73/1.73 |

OTHER PUBLICATIONS

"Clip on pipe thermistor sensor", AMWEI Thermistor, Dec. 21, 2011, www.imexbb.com, 2pp.

* cited by examiner

*Primary Examiner* — Alexander P Taousakis
(74) *Attorney, Agent, or Firm* — E. Randall Smith; Jones & Smith, LLP

(57) ABSTRACT

Apparatus useful for connecting a drain pan overflow sensor to the evaporator assembly of a ductless mini-split HVAC system includes at least one carrier extending upwardly from the overflow sensor and at least one connector releasably engageable with the carrier and at least one fin and/or evaporator coil tube of the evaporator assembly.

19 Claims, 5 Drawing Sheets

APPARATUS AND METHODS FOR CONNECTING A DRAIN PAN OVERFLOW SENSOR TO A DUCTLESS MINI-SPLIT HVAC SYSTEM

CROSS REFERENCE TO RELATED APPLICATIONS

This application claims priority to U.S. Provisional Patent Application Ser. Nos. 61/628,935 filed on Nov. 9, 2011 and entitled "Bracket for a Mini-Split Condensate Overflow Sensor", 61/630,627 filed on Dec. 15, 2011 and entitled "Bracket for a Mini-Split Condensate Overflow Sensor", and 61/742,729 filed on Aug. 17, 2012 and entitled "Bracket for Mini-Split Condensate Overflow Sensor", the entire contents of which are hereby incorporated by reference herein in their entireties.

FIELD OF THE INVENTION

The present disclosure relates generally to HVAC systems, and more particularly, to ductless mini-split HVAC systems.

BACKGROUND OF THE INVENTION

Ductless mini-split HVAC systems typically include an outdoor compressor unit and an indoor evaporator/fan unit and do not require a central system of ductwork. The outdoor and indoor units are usually connected by one or more conduits that contain electrical wiring, refrigerant lines and condensate tubing. The evaporator/fan unit often fits inside a slim case that mounts within the room or area to be air conditioned and may be ceiling, or wall, mounted.

A typical ductless mini-split HVAC system is controlled with a thermostat. When the temperature in the room exceeds a set-point of the thermostat, the outside compressor is automatically switched on. Refrigerant gas will be squeezed through a network of pipes and orifices in the compressor to raise its temperature and pressure. The refrigerant gas then moves into the condenser of the compressor, where a fan extracts heat from the refrigerant and exhausts it to the outside. When excess heat is removed, the refrigerant is transformed into a cool liquid. This cool liquid travels into the home through one or more tubes connecting the compressor and evaporator.

As the cool liquid refrigerant enters the building, its passes through an expansion valve and undergoes an abrupt reduction in pressure. The reduction in pressure will dramatically flash-evaporate part of the liquid refrigerant, lowering the temperature of the liquid/vapor mix. A fan unit within the evaporator will draw warm air from inside the room into the evaporator. The warm air is exposed to the cool refrigerant passing through evaporator coils or tubes, which absorbs excess heat from the air and thus cools down the room. The refrigerant with the excess heat from the room is then transferred back to the outside compressor and the cycle repeats.

A drain pan is normally included beneath the evaporator unit to catch overflow of condensate from the evaporator coils or tubes. An overflow sensor is associated with the drain pan to provide a warning or shut off the system if the drain pan is overflowing. This feature is very important for a ductless mini-split HVAC system, since the evaporator/fan unit is located inside the building and often inside the room to be cooled, and drain pan overflow can cause significant water damage.

At the same time, the ductless mini-split evaporator/fan units (and associated drain pan) are typically designed to be as small as possible for appearance and space reasons. Accordingly, the small desired footprint of a typical ductless mini-split unit causes challenges in designing all necessary components within the evaporator/fan unit and associated drain pan. In particular, this tight spacing causes difficulties in locating the overflow sensor in or above the drain pan. While standard HVAC evaporator units typically have plenty of space to position an overflow sensor bracket on the sidewall of the drain pan, presently known ductless mini-split HVAC systems are believed to lack an adequate arrangement for ideal positioning of the overflow sensor.

It should be understood that the above-described discussion is provided for illustrative purposes only and is not intended to limit the scope or subject matter of the appended claims or those of any related patent application or patent. Thus, none of the appended claims or claims of any related application or patent should be limited by the above discussion or construed to address, include or exclude each or any of the cited examples, features and/or disadvantages, merely because of the mention thereof herein.

Accordingly, there exists a need for improved systems, apparatus and methods useful to assist in placement of the drain pan overflow sensor in a ductless mini-split HVAC system having one or more of the features, attributes or capabilities described or shown in, or as may be apparent from, the various portions of this patent.

BRIEF SUMMARY OF THE DISCLOSURE

In some embodiments, the present disclosure involves apparatus for connecting a drain pan overflow sensor to the evaporator assembly of a ductless mini-split HVAC system. The evaporator assembly includes a drain pan disposed below a plurality of fins and evaporator coil tubes. The apparatus includes at least one elongated carrier configured to rigidly hold the overflow sensor proximate to its lower end. The carrier is configured to position the overflow sensor proximate to the drain pan. At least one connector is adjustably engageable with the carrier above the overflow sensor. The connector includes at least one engagement arm extending laterally outwardly relative to the elongated carrier. The engagement arm includes at least one gripper configured to engage at least one fin and/or evaporator coil tube of the evaporator assembly to secure the position of the connector relative to the evaporator assembly. The connector is configured so that after the gripper is engaged with at least one fin or evaporator coil tube, the position of the carrier is adjustable relative to the connector and the evaporator assembly, adjusting the position of the overflow sensor relative to the drain pan.

In various embodiments, the present disclosure involves apparatus for positioning a drain pan overflow sensor relative to the drain pan of an evaporator assembly in a ductless mini-split HVAC system. The evaporator assembly includes a plurality of fins and evaporator coil tubes disposed above the drain pan. The apparatus includes at least one elongated carrier extending upwardly from the overflow sensor and at least one connector adjustably engageable with the carrier above the overflow sensor. The connector includes at least one engagement arm extending laterally outwardly relative to the carrier. The engagement arm is configured to engage at least one fin and/or evaporator coil tube of the evaporator assembly to secure the position of the connector relative to the evaporator assembly. The carrier and connector are configured so that the position of the carrier is adjustable relative to the connector in order to select the position of the overflow sensor relative to the drain pan when the engagement arm is engaged with the fin(s) and/or evaporator coil tube(s) of the evaporator assembly.

In some embodiments, the present disclosure involves a method of positioning a drain pan overflow sensor relative to the drain pan of an evaporator assembly in a ductless mini-split HVAC system with the use of a drain pan overflow sensor assembly. The evaporator assembly includes a plurality of fins and evaporator coil tubes disposed above the drain pan. The drain pan overflow sensor assembly includes at least one elongated carrier extending upwardly from the overflow sensor, and a connector releasably engageable with the carrier and at least one fin and/or evaporator coil tube of the evaporator assembly. The method includes firmly engaging the connector with at least one fin and/or evaporator coil tube of the evaporator assembly. The carrier is moved vertically relative to the connector to select a desired position of the overflow sensor relative to the drain pan. When the position of the carrier relative to the connector establishes the desired position of the overflow sensor relative to the drain pan, the carrier and connector are firmly engaged.

Accordingly, the present disclosure includes features and advantages which are believed to enable it to advance ductless mini-split HVAC technology. Characteristics and advantages of the present disclosure described above and additional features and benefits will be readily apparent to those skilled in the art upon consideration of the following detailed description of various embodiments and referring to the accompanying drawings.

BRIEF DESCRIPTION OF THE DRAWINGS

The following figures are part of the present specification, included to demonstrate certain aspects of various embodiments of this disclosure and referenced in the detailed description herein.

DETAILED DESCRIPTION OF PREFERRED EMBODIMENTS

Figure 2:
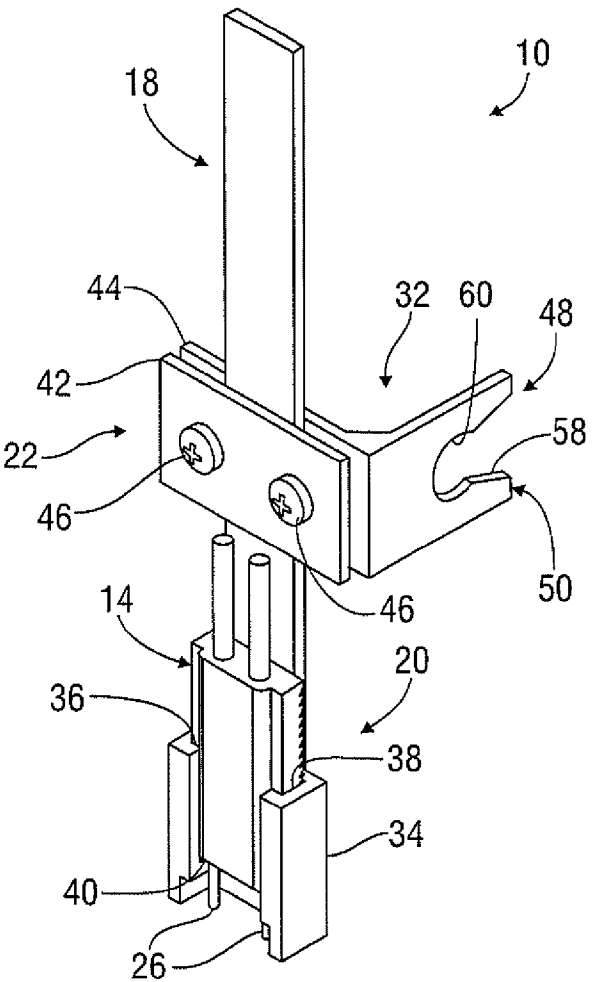
FIG. 2 is a perspective view of the drain pan overflow sensor assembly shown in FIG. 1.

Characteristics and advantages of the present disclosure and additional features and benefits will be readily apparent to those skilled in the art upon consideration of the following detailed description of exemplary embodiments and referring to the accompanying figures. It should be understood that the description herein and appended drawings, being of example embodiments, are not intended to limit the claims of this patent or any patent or patent application claiming priority hereto. On the contrary, the intention is to cover all modifications, equivalents and alternatives falling within the spirit and scope of the claims. Many changes may be made to the particular embodiments and details disclosed herein without departing from such spirit and scope.

In showing and describing preferred embodiments, common or similar elements are referenced with like or identical reference numerals or are apparent from the appended figures and/or the description herein. When multiple figures refer to a component or feature with the same reference numeral, any description herein of the component or feature with respect to any of the figures applies equally to the other figures to the extent such description does not conflict with a description herein of the other figure(s). The figures are not necessarily to scale and certain features and certain views of the figures may be shown exaggerated in scale or in schematic in the interest of clarity and conciseness.

As used herein and throughout various portions (and headings) of this patent, the terms "invention", "present invention" and variations thereof are not intended to mean every possible embodiment encompassed by this disclosure or any particular claim(s). Thus, the subject matter of each such reference should not be considered as necessary for, or part of, every embodiment hereof or of any particular claim(s) merely because of such reference. The terms "coupled", "connected", "engaged" and the like, and variations thereof, as used herein and in the appended claims are intended to mean either an indirect or direct connection or engagement. Thus, if a first device couples to a second device, that connection may be through a direct connection, or through an indirect connection via other devices and connections.

Certain terms are used herein and in the appended claims to refer to particular components. As one skilled in the art will appreciate, different persons may refer to a component by different names. This document does not intend to distinguish between components that differ in name but not function. Also, the terms "including" and "comprising" are used herein and in the appended claims in an open-ended fashion, and thus should be interpreted to mean "including, but not limited to . . . " Further, reference herein and in the appended claims to components and aspects in a singular tense does not necessarily limit the present disclosure or appended claims to only one such component or aspect, but should be interpreted generally to mean one or more, as may be suitable and desirable in each particular instance.

Figure 1:
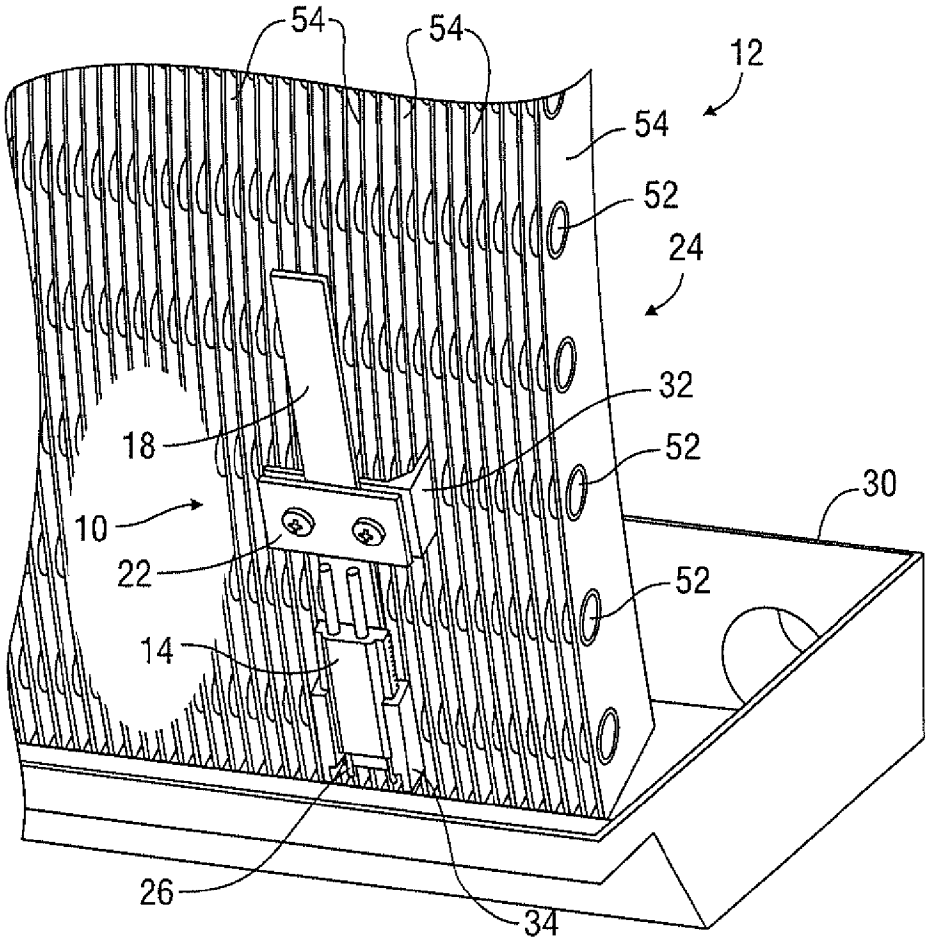
FIG. 1 is a perspective view of an exemplary ductless mini-split HVAC system with an embodiment of a drain pan overflow sensor assembly mounted thereon in accordance with the present disclosure.

Referring initially to FIG. 1, an embodiment of a drain pan overflow sensor assembly 10 is shown engaged with the evaporator assembly 24 of a ductless mini-split HVAC system 12. The illustrated drain pan overflow sensor assembly 10 includes an overflow water sensor or probe 14, a carrier 18 useful to hold the sensor 14 in the desired position and at least one connector 22 useful to connect the carrier 18 to the evaporator assembly 24.

Any suitable sensor 14, as is and becomes known in the art, may be used with the assembly 10. For example, the illustrated sensor 14 includes a pair of pins 26 (see FIG. 2) that can be positioned at the desired height relative to, or in, the drain pan 30 of the ductless mini-split HVAC system 12. Typically, the exemplary sensor 14 detects a change in resistance between the pins 26 when the pins 26 are exposed to a conductor, such as water and, in response, will actuate a cut-off switch (not shown) that turns off the mini-split HVAC system 12. The typical cut-off switch is designed to prevent overflow of water out of drain pan 30. One presently commercially available water sensor that can be used as sensor 14 in the assembly 10 is sold by Applicant, The Rectorseal Corporation, under product code SS500-EP #97693. It should be noted that the sensor 14 and all of the components of the mini-split HVAC system 12 are not part of the present invention. Accordingly, neither the type, configuration, operation, nor any other details of the sensor 14 or components of the mini-split HVAC system 12 are limiting upon the present disclosure or appended claims.

Referring now to the embodiment of FIG. 2, the carrier 18 may have any suitable form, configuration and operation sufficient to retain and position the sensor 14 relative to the drain pan 30 (FIG. 1) as desired, and may be constructed of any suitable material or combination thereof, such as, for example, metal or plastic. The illustrated carrier 18 is elongated and rigid, and firmly holds the sensor 14 proximate to its lower end 20. In this example, the carrier 18 includes a sensor holder 34 rigidly connected thereto at its lower end 20. The illustrated sensor holder 34 includes opposing slots 36, 38 with corresponding lower ledges 40, which together hold the sensor 14 in the desired position. However, the holder 18 may instead be integral to the carrier 18, or have any other desired form, configuration, location and operation. For example, the holder 18 may provide for adjustment of the position of the sensor 14 relative to the carrier 18. Moreover, a holder 34 may not be included, and the sensor 14 may be carried by the carrier 18 in any other suitable manner. Further, the sensor 14 may be integral to the carrier 18, or the carrier 18 may be an extension of the sensor 14.

The connector 22 may have any suitable form, configuration and operation sufficient to connect the carrier 18 to the evaporator assembly 24 as desired, and may be constructed of any suitable material or combination thereof, such as, for example, metal or plastic. In this embodiment, the connector 22 adjustably firmly engages the carrier 18 above the sensor 14. For example, the connector 22 may include front and rear plates 42, 44, which rigidly sandwich and fix the position of the carrier 18 relative to the connector 22 with the use of one or more releasable fasteners 46, such as nuts/bolts. Other examples of potentially suitable fasteners 46 are screws, clamps, Velcro, etc. Likewise, other adjustable fastening techniques may instead or also be used, such as friction fitting the connector 22 and carrier 18, or including mating configurations, such as notches and mating appendages or a ratchet arrangement (see e.g. FIGS. 6A-D) between the connector 22 and carrier 18. In this example, by releasing the fastener(s) 46, the position of the connector 22 relative to the carrier 18 may be adjusted and reset. This may be useful, for example, to reposition the height of the sensor 14 relative to the drain pan 30 (FIG. 1), or to use the drain pan overflow sensor assembly 10 with different sized evaporator assemblies 24. However, any other techniques for suitably engaging the connector 22 and carrier 18 may be used.

Still referring to the embodiment of FIG. 2, the illustrated connector 22 includes at least one engagement arm 32 configured to extend laterally outwardly from the carrier 18 for engagement with the evaporator assembly 24. The engagement arm 32 may have any suitable form, configuration and operation. In this example, the arm 32 is a vertically-oriented, plate-like protrusion extending from the rear plate 44 that is sized and configured to fit between adjacent generally vertically-oriented fins 54 (FIG. 1) of the evaporator assembly 24. As used herein, the terms "vertically-oriented" and variations thereof means upright, so that if the referenced item or portion of an item has opposing sides or faces, they will face generally horizontally and not up-and-down. The illustrated rear plate 44 is thus an L-shaped, vertically-oriented member, such as a piece of thin angle iron. While the engagement arm 32 of this embodiment is integral to the plate 44, in other embodiments, it may be a separate component connected with the rear plate 44 or another part of the connector 22.

In this embodiment, the arm 32 should be formed with a thickness that allows passage between adjacent fins 54 (see FIG. 1) of the evaporator assembly 24, but possess sufficient structural integrity and strength to support the carrier 18 and sensor 14. For example, if the width of the space between adjacent fins 54 of an evaporator assembly 24 is approximately 50 thousandths of an inch (0.005"), the thickness of the arm 32 may be less. For another example, the arm 32 may be formed with a thickness that is not less than the width of the space between adjacent fins 54, such as when any damage to the fins 54 caused by effectively forcing the arm 32 between them is not a concern. Thus, the thickness of the arm 32 will typically depend upon the particular circumstances of an application.

Still referring to FIG. 2, the exemplary engagement arm 32 includes at least one gripper 48 configured to engage the evaporator assembly 24 (FIG. 1). The gripper 48 may have any suitable shape, configuration and operation. In this embodiment, the gripper 48 is a cut-out formed in the arm 32 to slide over and engage a generally horizontally-oriented evaporator coil tube 52 (see FIG. 1) of the evaporator 24 when the arm 32 is slid between adjacent fins 54. In the illustrated embodiment, the gripper 48 includes a mouth 58 at its open end 50, which leads to a main portion 60 for engaging the coil tube 52. The exemplary mouth 58 is outwardly sloping, such as to assist in guiding the arm 32 over the evaporator coil tube 52 and guiding the tube 52 into the main portion 60. However, the outwardly sloping mouth 58 is not required in all embodiments.

Still referring to the embodiment of FIG. 2, the main portion 60 of the gripper 48 may have any suitable size, shape and orientation. In this example, the main portion 60 is semi-circular and sized to fit snugly around the coil tube 52 (FIG. 1), such as to prevent undesirable shifting or other unwanted movement of the sensor 14. For other examples, the main portion 60 may have an oval shape and/or may be sized to fit loosely over the coil tube 52. In yet other embodiments, the mouth 58 and/or main portion 60 of the gripper 48 may be smaller than the coil tube 52, such as when the engagement arm 32 is constructed of flexible material and can expand, bend or snap into engagement over the coil tube 52. In accordance with the above described embodiments, after the illustrated gripper 48 is engaged with at least one evaporator coil tube 52, the position of the carrier 18, and thus the sensor 14, is adjustable relative to the drain pan 30.

Figure 3C:
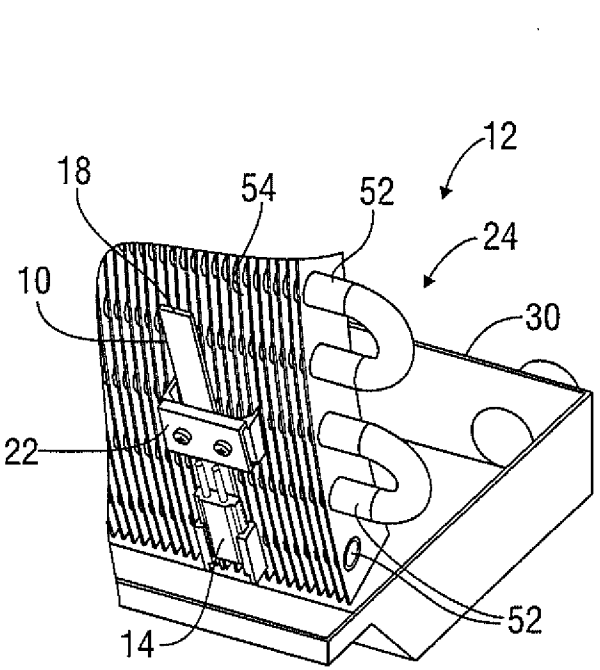
FIG. 3C is a perspective view of the drain pan overflow sensor assembly of FIG. 3A shown mounted on an exemplary ductless mini-split HVAC system.
Figure 3B:
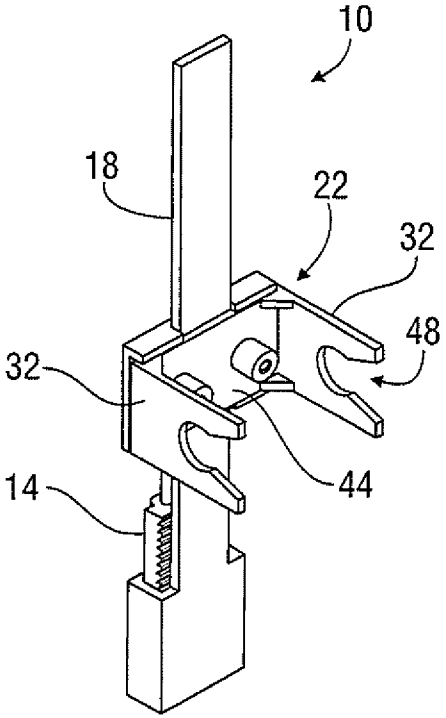
FIG. 3B is another perspective view of the drain pan overflow sensor assembly shown in FIG. 3A.
Figure 3A:
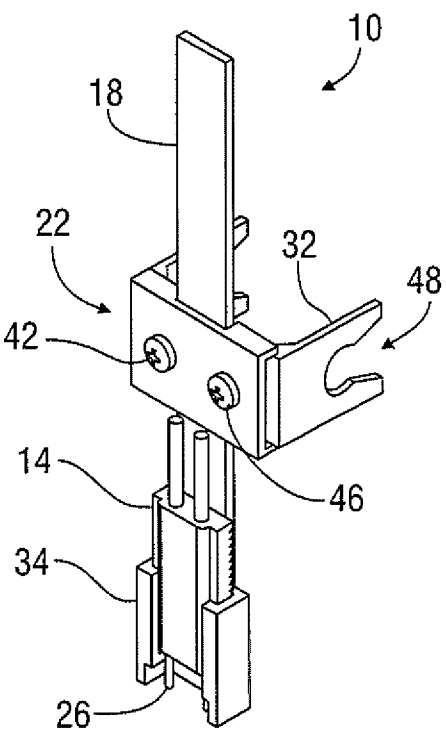
FIG. 3A is a perspective view of another embodiment of a drain pan overflow sensor assembly in accordance with the present disclosure.
Figure 4C:
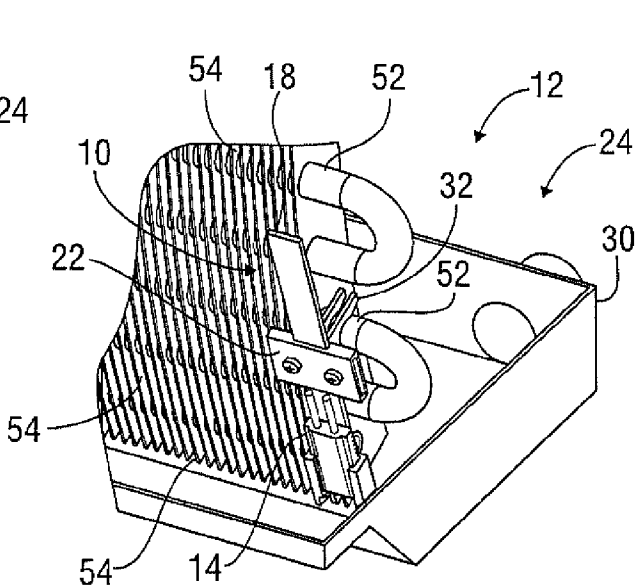
FIG. 4C is a perspective view of the drain pan overflow sensor assembly of FIG. 4A shown mounted in a second exemplary location on an exemplary ductless mini-split HVAC system.
Figure 4B:
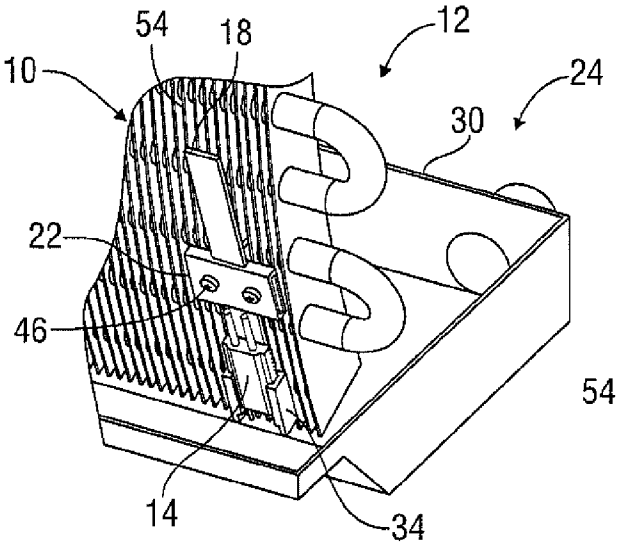
FIG. 4B is a perspective view of the drain pan overflow sensor assembly of FIG. 4A shown mounted in a first exemplary location on an exemplary ductless mini-split HVAC system.
Figure 4A:
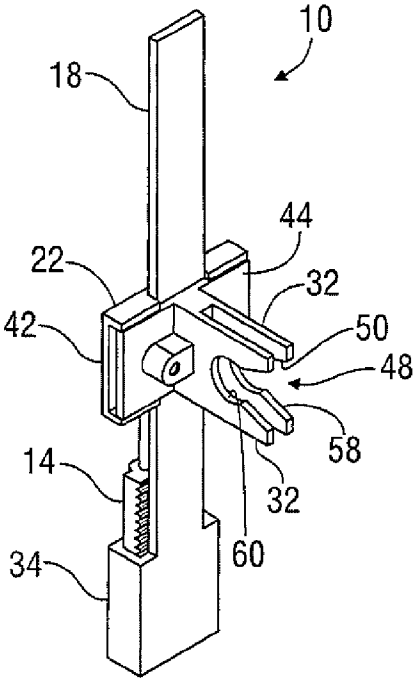
FIG. 4A is a perspective view of another embodiment of a drain pan overflow sensor assembly in accordance with the present disclosure.

The connector 22 may include any desired number of engagement arms 32. For example, in the embodiments of FIGS. 3-4, the illustrated connectors 22 include two engagement arms 32 for engaging an evaporator coil tube 52 (See FIGS. 3C, 4B-C). The inclusion of two or more engagement arms 32 may be useful, for example, to provide additional strength and/or stability to the assembly 10, or for other reasons. In FIGS. 3A-C, for example, the illustrated arms 32 are spaced wide apart, such as to provide greater stability of the assembly 10. In FIGS. 4A-C, the arms 32 are spaced close together and positioned within the same axis as the carrier 18, such as to provide additional strength to the assembly 10 or allow for additional positioning options of the assembly 10 in the ductless mini-split HVAC system 12 (FIGS. 4B-C). For example, the arms 32 of this embodiment may be engaged to an evaporator coil tube 52 between fins 54 (e.g. FIG. 4B), or to the end of a coil tube 52 at a "U shaped" turn outside the fin area of the evaporator assembly 24 (e.g. FIG. 4C). The latter placement may be preferred in some applications, such as to reduce the likelihood of damaging the fins 54 since the arms 32 do not need to be placed in between the fins 54. This may be beneficial, for example, when the fins 54 are tightly spaced and/or may be fragile, or to provide quicker and easier installation.

Figure 5C:
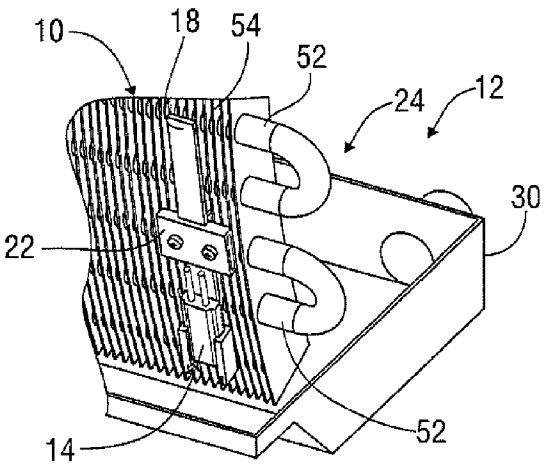
FIG. 5C is a perspective view of the drain pan overflow sensor assembly of FIG. 5A shown mounted on an exemplary ductless mini-split HVAC system.
Figure 5D:
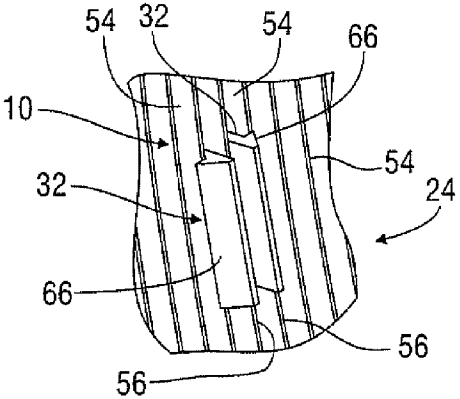
FIG. 5D is an exploded front view of the engagement arms of the exemplary drain pan overflow sensor assembly of FIG. 5C shown engaging the ends of the fins of the exemplary ductless mini-split HVAC system.
Figure 5B:
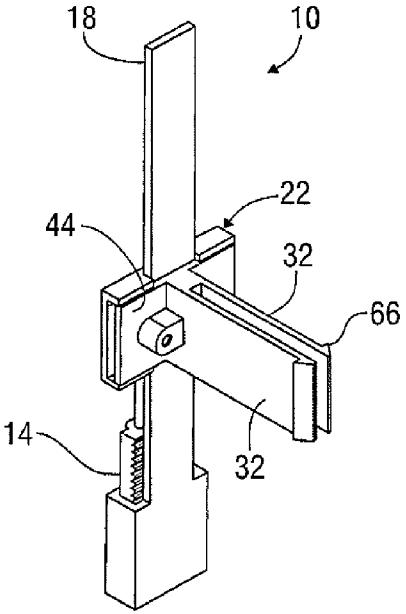
FIG. 5B is another perspective view of the drain pan overflow sensor assembly shown in FIG. 5A.
Figure 5A:
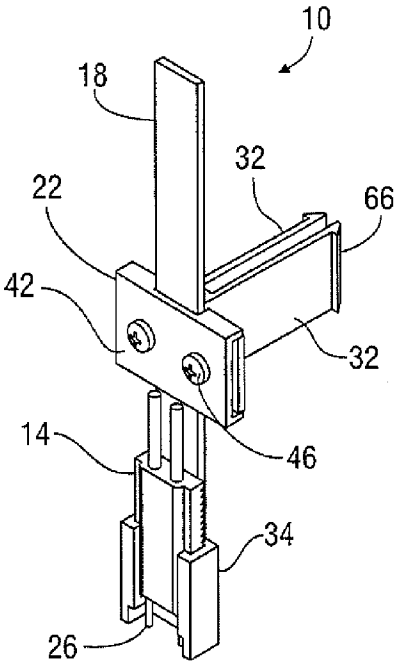
FIG. 5A is a perspective view of another embodiment of a drain pan overflow sensor assembly in accordance with the present disclosure.

In other embodiments, the connector 22 may be configured to engage one or more fins 54, instead of engaging an evaporator coil tube 52. The connector 22 of these embodiments may have any suitable form, configuration and operation. In FIG. 5A-D, for example, the illustrated connector 22 includes two closely spaced engagement arms 32 configured to expand outwardly relative to one another into engagement with different fins 54. These exemplary arms 32 possess sufficient flex so that they can be compressed toward one another when inserted into one or more spaces between multiple fins 54. Thereafter, each exemplary arm 32 will flex outwardly into gripping engagement with a different fin 54 in order to firmly hold the assembly 10 at the desired height in the evaporator assembly 24. Referring particularly to FIGS. 5C-D, if desired, an outwardly oriented hook 66 may be provided at the end of one or more of the engagement arms 32 to grip the end 56 of the corresponding fin 54. This may be useful in some applications, such as to firmly secure the connector 22 at the desired height in the evaporator assembly 24 and/or prevent easy or unintended removal of the connector 22 therefrom.

In other embodiments, the engagement arms 32 may be configured to squeeze or clamp inwardly relative towards one another into engagement with one or more fins 54. For example, the arms 32 could be biased toward one another and forced over a single fin 54 to snap onto, or grip, the fin 54 and firmly hold the assembly 10 at the desired height in the evaporator assembly 24. Likewise, the arms 32 could be designed to inwardly grip different fins 54 as they are forced over the outer sides of the respective fins 54. If desired, an inwardly oriented hook (not shown) may be provided at the end of one or more of the arms 32 to grip the end 56 of the corresponding fin 54. This may be useful in some applications, such as to firmly secure the connector 22 at the desired height and in the evaporator assembly 24 and/or prevent inadvertent removal of the connector 22 therefrom.

Figure 6D:
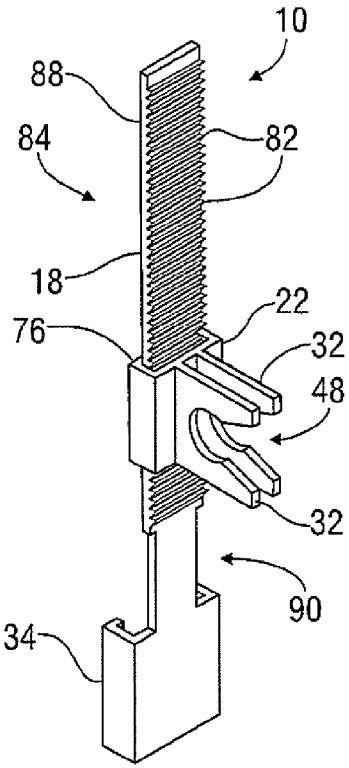
FIG. 6D is a perspective view of the drain pan overflow sensor assembly shown in FIG. 6A.
Figure 6C:
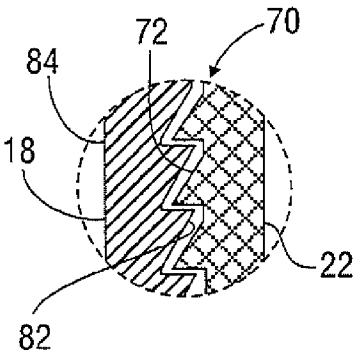
FIG. 6C is an exploded view of the mating teeth of the exemplary drain pan overflow sensor assembly shown in FIG. 6B.
Figure 6B:
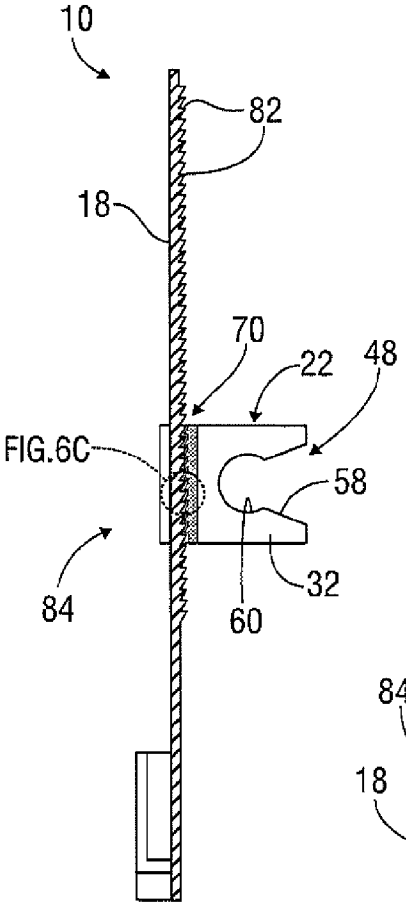
FIG. 6B is a cross-sectional view of the drain pan overflow sensor assembly shown in FIG. 6A taken along line 6B-6B.
Figure 6A:
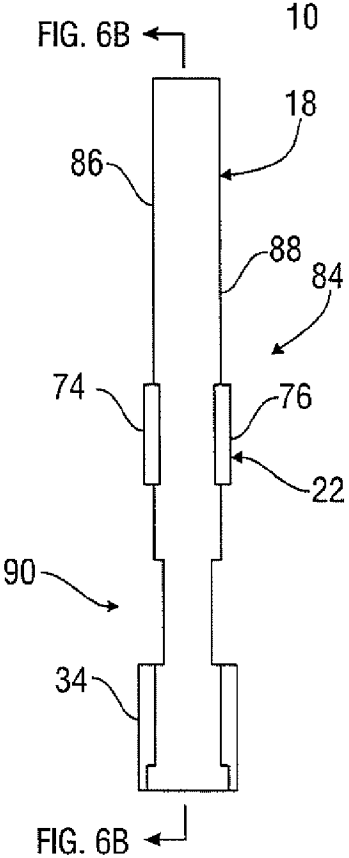
FIG. 6A is a rear view of another embodiment of a drain pan overflow sensor assembly in accordance with the present disclosure.

In the embodiment of FIGS. 6A-D, the connector 22 releasably engages the carrier 18 with a ratchet mechanism 70. Any suitable ratchet mechanism 70 may be used. In this example, as shown in FIG. 6C, the connector 22 has one or more teeth, or ridges, 72 extending therefrom which engage one or more opposing teeth, or ridges, 82 extending along an upper portion 84 of the carrier 18. The exemplary teeth 72, 82 engage one another in a ratchet-like manner to firmly secure the relative position of the connector 22 and carrier 18. As shown in FIG. 6A, the exemplary connector 22 also has left and right lips 74, 76 that each extend around the respective edges 86, 88 of the upper portion 84 carrier 18. In this embodiment, the lips 74, 76 are configured to fit snugly around the edges 86, 88.

In this embodiment, the connector 22 is configured to be moveable relative to the carrier 18 in only the upward vertical direction. One-way, ratchet-like, attachment devices using mating teeth, or ridges, which can be incorporated into one or more embodiments of the assembly 10 are well known in the art and are presently discussed, for example, at www.wikipedia.com under the title "cable straps". However, the teeth 72, 82 may instead be configured to allow movement in only the downward vertical direction, or the connector 22 may be configured with sufficient horizontal play relative to the carrier 18 to allow its movement in either direction.

Referring to FIGS. 6A and 6D, if desired, the illustrated carrier 18 may be formed with a narrow portion 90 below the upper portion 84, such as to allow the connector 22 to be repositioned on the carrier 18. The narrow portion 90 of this embodiment is sized such that connector 22 can be placed over the narrow portion 90 and freely slid upwardly onto the upper portion 84 and into engagement with the teeth 82. This can be useful, for example, when a user inadvertently or mistakenly raises the connector 22 too high relative to the carrier 18 (i.e. the sensor 14 is too high above the drain pan 30). In such instances, the connector 22 can be ratcheted up to the top of carrier 18, removed therefrom and placed back onto carrier 18 at the lower portion 90 to try again. These embodiments may be desirable in some applications, such as to provide greater ease of use, to reduce the number of components and connection points and/or reduce the need for tools to use the system 10.

An exemplary method of use of the embodiment of FIGS. 1-2 will now be described. The illustrated sensor 14 is placed in position in the carrier 18. The connector 22 may be firmly engaged with the carrier 18. The exemplary engagement arm 32 of the connector 22 is inserted between adjacent fins 54 of the evaporator assembly 24 so that the mouth 58 of the gripper 48 engages an evaporator coil tube 52. In some applications, these actions can be performed in any desired order.

Once the illustrated connector 22 is engaged with the evaporator assembly 24, the height of the sensor 14 relative to the drain pan 30 may be changed to the desired height. In this example, that can be done by adjusting the position of the carrier 18 relative to the connector 22. For example, the exemplary fasteners 46 are loosened to allow the carrier 18 to be slid up or down, as desired, relative to the connector 22. When the desired height of the sensor 14 is achieved, the fasteners 46 are tightened to firmly secure the connector 22 and carrier 18. Alternately, instead of adjusting the position of the carrier 18 relative to the connector 22, the connector 22 may be simply moved to a different evaporator coil tube 52 that positions the sensor 14 at the desired height. It should be noted that this alternative technique would be necessary in embodiments of the drain pan overflow sensor assembly 10 in which the connector 22 is not adjustable relative to the carrier 18.

Preferred embodiments of the present disclosure thus offer advantages over the prior art and are well adapted to carry out one or more of the objects of this disclosure. However, the present invention does not require each of the components and acts described above and is in no way limited to the above-described embodiments, variables, values, value ranges or methods of operation. Any one or more of the above components, features and processes may be employed in any suitable configuration without inclusion of other such components, features and processes. Moreover, the present invention includes additional features, capabilities, functions, methods, uses and applications that have not been specifically addressed herein but are, or will become, apparent from the description herein, the appended drawings and claims. Further, all of the value and value ranges provided herein and in the appended claims are intended to be approximate, as that term is defined herein.

The methods that may be described above or claimed herein and any other methods which may fall within the scope of the appended claims can be performed in any desired suitable order and are not necessarily limited to any sequence described herein or as may be listed in the appended claims. Further, the methods of the present invention do not necessarily require use of the particular embodiments shown and described herein, but are equally applicable with any other suitable structure, form and configuration of components.

While exemplary embodiments of the invention have been shown and described, many variations, modifications and/or changes of the system, apparatus and methods of the present invention, such as in the components, details of construction and operation, values, arrangement of parts and/or methods of use, are possible, contemplated by the patent applicant(s), within the scope of the appended claims, and may be made and used by one of ordinary skill in the art without departing from the spirit or teachings of the invention and scope of appended claims. Thus, all matter herein set forth or shown in the accompanying drawings should be interpreted as illustrative, and the scope of the disclosure and the appended claims should not be limited to the embodiments described and shown herein.

The invention claimed is:

1. Apparatus for connecting a drain pan overflow sensor to the evaporator assembly of a ductless mini-split HVAC system, the evaporator assembly including a drain pan disposed below a plurality of generally vertically-oriented fins and generally horizontally-oriented evaporator coil tubes, the apparatus comprising:

at least one elongated carrier having an upper end and a lower end and being configured to rigidly hold the overflow sensor proximate to said lower end, said carrier being configured to position the overflow sensor proximate to the drain pan; and at least one connector adjustably engageable with said carrier above the overflow sensor, said connector including at least one engagement arm extending laterally outwardly relative to said carrier, said engagement arm configured to engage at least one among at least one fin and at least one evaporator coil tube of the evaporator assembly to secure the position of said connector relative to the evaporator assembly, said connector being configured so that after said engagement arm is engaged with at least one fin or evaporator coil tube, the position of said carrier is adjustable relative to said connector and the evaporator assembly, adjusting the position of the overflow sensor relative to the drain pan.

2. The apparatus of claim 1 wherein said engagement arm includes a plate-like protrusion that extends laterally outwardly relative to said carrier.

3. The apparatus of claim 2 wherein said engagement arm includes at least one gripper engageable with at least one evaporator coil tube of the evaporator assembly.

4. The apparatus of claim 3 wherein said gripper is a cut-out slideably engageable onto an evaporator coil tube.

5. The apparatus of claim 4 wherein said cut-out includes an outwardly sloping mouth configured to assist in guiding said gripper onto the evaporator coil tube and a semi-circular main portion engageable around the evaporator coil tube.

6. The apparatus of claim 1 wherein said connector includes front and rear plates releasably engageable on opposite sides of said carrier and at least one fastener configured to releasably secure the position of said front and rear plates relative to said carrier.

7. The apparatus of claim 1 wherein said connector includes first and second engagement arms configured to engage the same evaporator coil tube of the evaporator assembly between one or more of the fins.

8. The apparatus of claim 1 further including a plurality of teeth formed on said connector and a plurality of opposing teeth formed on said carrier, said teeth of said connector being releasably, mateably engageable with said teeth of said carrier to secure, release and re-secure the position of said carrier relative to the said connector.

9. The apparatus of claim 8 wherein said connector and said carrier are configured to be moveable relative to one another in only one vertical direction.

10. The apparatus of claim 1 wherein said connector includes first and second engagement arms configured to engage the same evaporator coil tube of the evaporator assembly on the outer side of an outermost fin.

11. The apparatus of claim 1 wherein said connector includes first and second engagement arms configured to expand outwardly relative to one another into engagement with first and second fins of the evaporator assembly.

12. The apparatus of claim 11 further including an outwardly facing hook disposed on the end of each of said first and second engagement arms, said hooks configured to grip the respective ends of the first and second fins.

13. The apparatus of claim 1 wherein said connector includes first and second engagement arms configured to clamp onto or grip the same fin of the evaporator assembly.

14. Apparatus for positioning a drain pan overflow sensor relative to the drain pan of an evaporator assembly of a ductless mini-split HVAC system, the evaporator assembly including a plurality of fins and evaporator coil tubes disposed above the drain pan, the apparatus comprising:

at least one elongated carrier extending upwardly from the overflow sensor; and at least one connector adjustably engageable with said carrier above the overflow sensor, said connector including at least one engagement arm extending laterally outwardly relative to said carrier, said engagement arm configured to engage at least one among at least one fin and at least one evaporator coil tube of the evaporator assembly to secure the position of said connector relative to the evaporator assembly, said carrier and said connector being configured so that the position of said carrier is adjustable relative to said connector in order to select the position of the overflow sensor relative to the drain pan when said engagement arm is engaged with at least one among at least one fin and at least one evaporator coil tube of the evaporator assembly.

15. The apparatus of claim 14 wherein said engagement arm includes a plate-like protrusion that extends laterally outwardly relative to said carrier.

16. The apparatus of claim 14 wherein said connector includes front and rear plates releasably engageable on opposite sides of said carrier and at least one fastener configured to releasably secure the position of said front and rear plates relative to said carrier.

17. The apparatus of claim 14 wherein said connector includes first and second engagement arms configured to engage the same evaporator coil tube of the evaporator assembly.

18. The apparatus of claim 14 further including a plurality of teeth formed on said connector and a plurality of opposing teeth formed on said carrier, said teeth of said connector being releasably, mateably engageable with said teeth of said carrier to secure, release and re-secure the position of said carrier relative to the said connector.

19. The apparatus of claim 14 wherein said connector includes first and second engagement arms configured to expand outwardly relative to one another into engagement with first and second fins of the evaporator assembly.

* * * * *